United States Patent [19]

Doherty et al.

[11] Patent Number: 4,663,241

[45] Date of Patent: May 5, 1987

[54] POWDER METAL DISK WITH SELECTIVE FATIGUE STRENGTHENING

[75] Inventors: James E. Doherty, Westbrook; Charles G. Nessler, Chester, both of Conn.

[73] Assignee: United Technologies Corporation, Hartford, Conn.

[21] Appl. No.: 504,097

[22] Filed: Jun. 13, 1983

Related U.S. Application Data

[63] Continuation of Ser. No. 184,693, Sep. 8, 1980, abandoned.

[51] Int. Cl.[4] ..... B22F 3/26

[52] U.S. Cl. ..... 428/547; 428/567; 428/579

[58] Field of Search ..... 75/200 R, 211, 226, 75/246; 428/547, 548, 567, 579

[56] References Cited

U.S. PATENT DOCUMENTS

| | | | |
|---|---|---|---|
| 2,267,918 | 12/1941 | Hildabolt | 29/189 |
| 2,757,901 | 8/1956 | McVeigh | 428/579 X |
| 3,780,418 | 12/1973 | Hurst | 29/420 |
| 3,846,126 | 11/1964 | Foley et al. | 75/221 X |
| 4,054,449 | 10/1977 | Dunn et al. | 75/226 X |
| 4,062,678 | 12/1977 | Dreyer et al. | 75/228 |
| 4,063,939 | 12/1977 | Weaver et al. | 75/226 X |
| 4,101,712 | 7/1978 | Bomford et al. | 428/547 |

*Primary Examiner*—Peter A. Nelson

*Attorney, Agent, or Firm*—C. G. Nessler; Charles E. Sohl

[57] ABSTRACT

Disclosed is a gas turbine disk made from powder metal, wherein the bore has improved fatigue life compared to conventional articles because the bore is formed from a fine fraction of powder separated from a lot of conventional powder metal suitable for hot isostatic compaction. The outer and rim portions of the disk, which are less prone to fatigue failure, are made from the remainder of the lot but nonetheless have no more limited performance from that resulting when a unitary unseparated powder lot is used. Improved bore fatigue properties result because the coarse fatigue failure-causing nonmetallic inclusions are biased into the outer portions of the disk where they do not have adverse effect.

2 Claims, 4 Drawing Figures

POWDER METAL DISK WITH SELECTIVE FATIGUE STRENGTHENING

This application is a continuation of application Ser. No. 184,693, filed Sept. 8, 1980 and now abandoned.

BACKGROUND

1. The invention relates to fatigue resisting structures made of powder metals, most particularly gas turbine disks.

2. Structures made of powder metals which are subjected to cyclic stresses often fail by fatigue cracks which initiate from flaws in the metal structure. Metallurgical examination of failed turbine disks often shows that fatigue cracks tend to initiate from ceramic inclusions and other flaws which were contained with the powder. Various techniques may be used to eliminate such ceramic inclusions, but to date the efficiency and cost thereof still leaves them somewhat wanting. Patent application Ser. No. 184,730, entitled "Fatigue Resistant Articles Made From Fine Metal Powder" by Slack et al, filed on even date hereof, discloses a process whereby the fatigue life of powder metal turbine disks is improved by using fine powder. This approach can involve increased cost in powder manufacture, since it is generally more difficult to make fine powder than coarse and the separated coarse fraction must be remelted or otherwise disposed of. The invention disclosed herein is in some respects an improvement on the Slack and Wentzell invention, and provides an alternate method for obtaining fatigue resisting turbine disks.

DISCLOSURE OF INVENTION

An object of the invention is to improve the fatigue properties of gas turbine disks and similar structures compared to the properties which result from conventional powder metal lots. A further object of the invention is to improve the utilization of ordinary metal powder lots compared to that which results when only fine powder is used. Another object is to attain adequate properties in other portions of a disk where fatigue is not the most limiting factor.

According to the invention, a fine fraction is separated from a powder lot and preferentially positioned to form the more fatigue limited portion of an article, while the remainder from the separation is used to form the other portions. This differentiation results in elimination of the larger failure causing ceramic inclusions from the fatigue prone portions and their biasing into the other portions. But the durability of the parts of the structure made from the remainder are not adversely affected because the fatigue stresses are by definition lower, and the maximum flaw size is unchanged by the biasing; only the distribution is changed.

In a disk, the quantity of powder necessary to form the bore is relatively small, compared to the total quantity of powder in the structure. This reduces the amount of powder processing which is necessary and make the use of the invention feasible. A representative article formed in accord with the invention will have a bore portion formed from fine powder, having a depth (or radially outward distance) of about 0.2 cm.

Advantages of the invention include the elimination of the necessity for removing all ceramic inclusions, for manufacturing powder to very fine total particle sizes, or for discarding substantial quantities of coarse powder. In use, the disk will be found to exhibit improved fatigue life, compared to a disk made from an identical powder lot which was not separated in the manner described.

The foregoing and other objects, features and advantages of the present invention will become more apparent from the following description of preferred embodiments and accompanying drawings.

BEST MODE FOR CARRYING OUT THE INVENTION

The present invention is described in terms of a gas turbine disk made of nickel superalloy, but it is equally applicable to other structures and materials.

Figure 1:
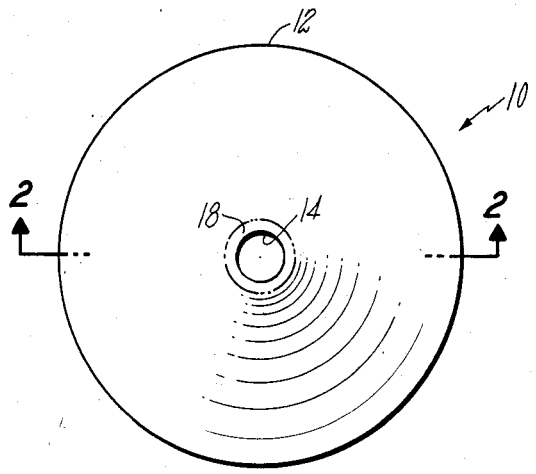
FIG. 1 is a planar view of the disk.
Figure 2:
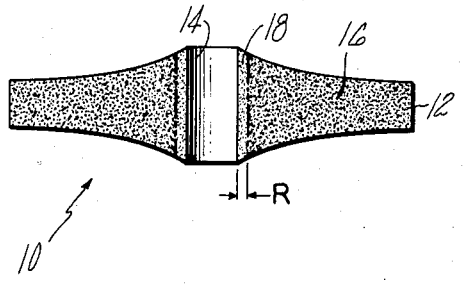
FIG. 2 is a diametrical cross section through the disk in FIG. 1.

FIG. 1 shows a planar view of a partially machined gas turbine disk 10, having a rim 12 and a bore hole 14. FIG. 2 is a diametrical cross section of the disk 10.

In use, gas turbine disks are subjected to varying temperatures and stresses. The innermost part 18 adjacent the bore hole (hereafter called the "bore") is characteristically at a moderate temperature and subjected to high cyclic tensile stresses which predominately tend to produce failure by fatigue cracking; while the outermost rim 12 is subjected to high temperatures and steady state stresses which tend to result in creep failure by creep or stress rupture. The exact point at which the potential failure mode switches from fatigue to stress rupture is dependent on the particular disk. But the most significant and limiting fatigue cracks initiate near the surface of the bore hole 14, and it is to this particular region that our improvement most directly relates. In the invention the bore 18, a portion extending outwardly a radial distance R from the bore hole is made of a powder fraction especially processed to enhance fatigue life, while the rest of the disk 16 is made of residual powder and functions substantially as if it were made of powder without the practice of the invention.

Figure 3:
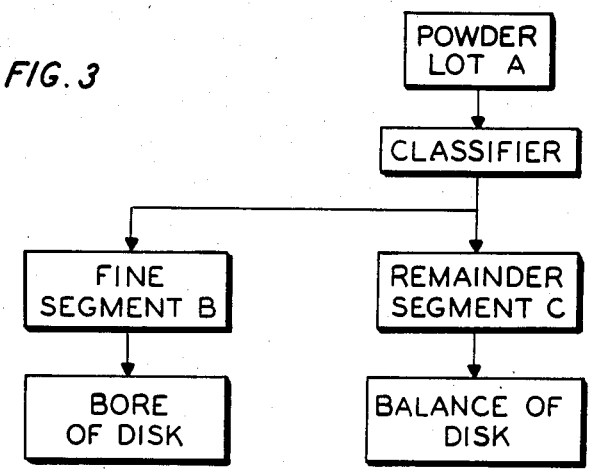
FIG. 3 shows the powder processing steps in making an inventive disk.
Figure 4:
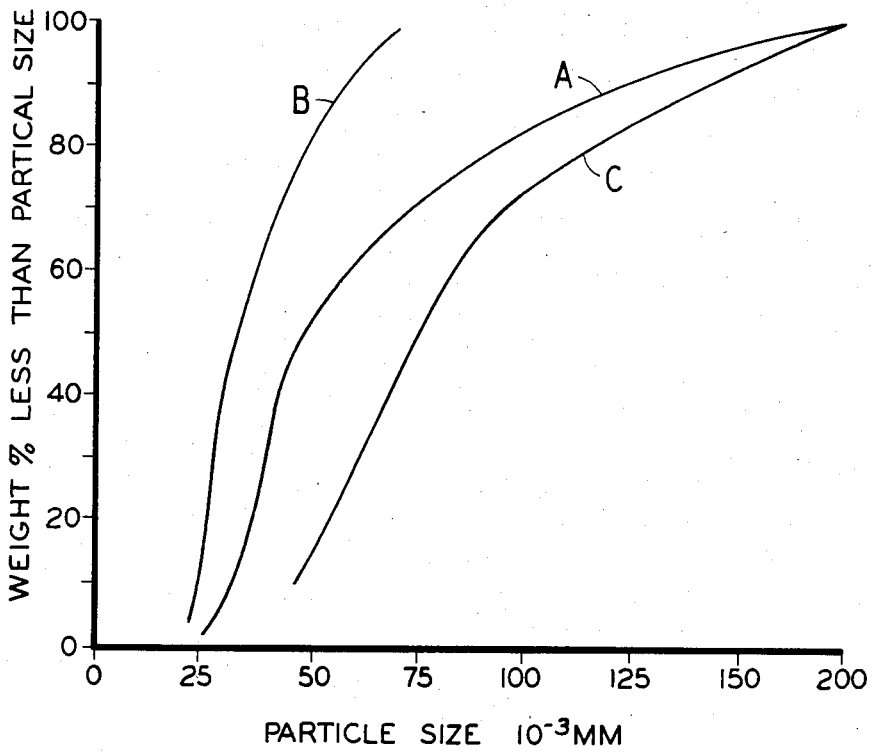
FIG. 4 represents the particle distribution of a normal lot of powder, and the particle distribution of the two fractions produced from the lot.

The practice of the invention is illustrated by FIGS. 3 and 4. A unitary powder lot A having a normal particle distribution, such as shown in FIG. 4, is processed according to the schedule shown in FIG. 3 by first passing it through a classifier to produce a fine fraction B and a coarse fraction C. The classifier may be any of a number of mechanical or fluid classifiers, but screens are preferred, to produce a fine lot fraction B having nominal particle distribution characteristics shown in FIG. 4. Namely, the maximum particle size present in lot B is significantly less than the maximum particle size for the initial powder lot A. The maximum particle size of lot B will be selected to achieve the desired fatigue life objective, according to the teachings of the aforementioned Slack et al application which is hereby incorporated by reference. The selection will necessarily be constrained by the feasibility of producing from lot A the necessary lot B quantity to form the fatigue resisting bore portion of the disk.

A disk is best made by hot isostatic pressing, and that process is carried out by introducing powder into a metal container, and then evacuating and compacting the container. Application Ser. No. 184,729 filed on even date hereof, now abandoned by D. J. Evans entitled "Fabrication of Dual Material Powder Metal Disks", sets forth procedures for forming a disk of two different materials, which may be used in making our inventive disk; the disclosure thereof is incorporated by reference. An alternate method of forming our disk using conventional pressing is set forth in U.S. Pat. No. 3,780,418 by Hurst.

To produce our improved disk, the remainder fraction C is formed into the central and outer portion 16 of the disk, as shown in FIG. 2; this comprises the bulk of the mass of the disk. The fine fraction B is introduced into the container so that it forms the bore portion 18. It is desirable to minimize the quantity of fraction B material. Therefore the powder receiving container will either be shaped to produce the bore hole in the original pressed object, or have within an expendable mandrel, as mentioned in the Evans application. The outward distance, R (FIG. 2), is also minimized to that point at which the fatigue stresses are sufficiently lowered, due to disk design and use. Inherently, the fatigue stresses generally decrease in the outward direction. Therefore R will be chosen such that at points beyond R the fatigue stresses in the lot C powder formed material will provide life equal or greater than the fatigue life provided in the lot B powder formed material at points within R. Commonly in gas turbine disks it has been found that fatigue failures initiate from the cylindrical surface defining the bore hole, or from just below the surface, up to about 0.2 cm deep. Thus the hollow cylindrical area adjacent the length of the bore, to a depth of about 0.2 cm must be made of the fine fraction. A greater thickness or depth is useful as a conservative measure but unnecessarily wasteful to the extent the precision of placement can be controlled. Generally we prefer that the radial thickness in a finished machined disk be in the range 0.3 to 1.0 cm; thus in the unmachined disk there will be more according to the machining allowance provided for the hole which is usually about 0.13–0.8 mm. Thus the thickness in a pressed disk will range from 0.4–1.8 cm. After the powders are introduced into the disk-shaped container with due consideration for dimension change during consolidation, they are compacted by pressing at high temperature, preferably isostatically, but alternatively statically.

Referring to the copending Slack et al application, the fatigue properties will be determined by the maximum particle size of the powder of which an article is comprised. Consequently the disk of our invention will have improved fatigue life owing to the placing of the fine fraction B in the bore. The fine fraction, having a lesser maximum particle and inclusion size than either the original lot A or the remainder lot C will provide the best fatigue properties. However, most beneficially, the parts of the disk made from the remainder portion C will not have significantly adverse properties compared to a disk made from the original lot A. The reasons for this are severalfold: The maximum particle size of lot C is no greater than lot A and thus the fatigue failure threshold is not lowered. (Notwithstanding, some statistical argument may be made that the fatigue resistance is lower, but fatigue stresses of the outer portion and rim region are lower; and the quantity of additional failure sources in lot C compared to unseparated lot A is relatively small, notwithstanding the benefit provided to lot B by their removal.) The particle distribution of lot C is altered by removal of some of the fines, but lot B is purposefully relatively small compared to lot C. Surface area to volume ratio of lot C is lowered and if anything, this is beneficial in reducing contamination. The grain size produced in disks made from fine and coarse fractions will not be significantly different, since all the original lot particles have relatively fine grain and are heated to cause grain growth.

Thus, our invention provides improved fatigue life in disks without disadvantage in performance of the disk elsewhere. The cost of powder material should be reduced since waste or discard of material, or great refinement of the manufacturing process is avoided.

Generally, the invention involves separating a powder lot into a first fraction having a maximum particle size less than the lot, and a second fraction which has a maximum particle size the same as the lot. The consolidated disk of the invention is made from a unitary lot of material, but has a first portion subjected to higher fatigue stresses containing only fine powder fraction and a second portion subject to lower fatigue stresses than the first, made from a coarse powder fraction. Desirably each fraction is part of a total lot, but some powder may be discarded.

The distribution of ceraric inclusions by weight is generally a normal distribution with a maximum nominal size of about 0.175 mm (80 mesh screen size). So, too, the weight distribution of the metal powder is normal. Therefore it can be said that in the preferred embodiment the consolidated disk is comprised of a bore having a first inclusion size distribution and the rest of the disk has a second inclusion size distribution, both these distributions being truncations from an original distribution.

The following example is illustrative of our invention: A powder metal disk is to be made from an alloy having a composition 12.4 Cr, 18.5 Co, 4.3 Ti, 5 Al, 3.2 Mo, 1.4 Nb, 0.4 Hf, 0.06 Zr, 0.2 B, 0.05 C, balance Ni. The alloy is formed into an atomized powder having the following weight distribution by mesh size: 20% −80+200; 20% −200+325; and 60% −325. The disk to be made has a weight of about 75 kg and a volume of about 8000 cubic centimeters. The powder is passed over 325 mesh U.S. Sieve size screens having openings of about 0.044 mm, and about 6 kg (or 15% of the total weight is caused to pass through the screen) to form the fine-fraction. The material from which the fines have been removed (about 10 kg) is reblended with the original lot which was not screened; this reblend is designated the remainder portion. A metal container is provided which defines the dimensions of the sought-for disk, with due allowance for the shrinkage that will take place upon compaction, and for machining allowance. The disk has an outer diameter of about 300 cm, an inner diameter of about 9 cm, an axial thickness at the rim of about 3 cm and at the bore of about 10 cm. The remainder fraction of the separated powder is first introduced into the container to form the rim. Next the fine fraction is introduced to form the bore portion. The container is sealed, hot isostatically compacted at 1190° C., 103 MPa for 3 hours and then the container is removed from the consolidated power metal disk. Metallurgical examination reveals that the portion adjacent the bore has been formed of the fine fraction, the portion being in configuration like a hollow cylinder having about a 2.5 cm thick wall. When the inner diameter of the bore is machined to form the finished turbine disk, the fine fraction represents a region about 1.5 cm thick as measured from the surface of the bore radially outward.

The objects of our invention are best carried out by forming the part from the separate fractions in one step as set forth in the example. However, in alternate mode, one portion may be formed in one pressing, to be joined to the remainder portion in a subsequent pressing, or other joining operation if the remainder is also formed separately.

The prime region for fatigue limiting behavior in gas turbine disks is the bore, which is the subject of the preferred embodiment. However, fatigue is also found at other parts of the disk most particularly at holes which pass through central or web parts of the disk. It would be within our contemplation to place fine powder near these features as a logical extension of our invention. Also, it should be evident that the invention will be applicable to other objects than disks including those with multiple portions needing high resistance to fatigue; for these the most fatigue stressed regions will be likewise made of the fine fraction. Further, more than one fraction may be separated from the original powder lot; for example, the lot may be separated into three fractions having progressively different fatigue properties, and the fractions placed within a structure in accord with the teachings herein.

Although this invention has been shown and described with respect to a preferred embodiment, it will be understood by those skilled in the art that various changes in form and detail thereof may be made without departing from the spirit and scope of the claimed invention.

We claim:

1. A disk formed from metal powder and having a bore hole, where in service the highest fatigue stresses are encountered, said metal powder having contained ceramic contaminants which act as initiation sites for fatigue cracks; said disk comprising a portion immediate adjacent the bore having a first maximum ceramic inclusion rate and a portion comprising the balance of the disk having a second maximum ceramic inclusion size, said first inclusion size being less than said second inclusion size as a consequence of said bore portion having been produced from finer powder than the powder used to form the balance of the disk.

2. In the method of fabricating an article from metal powder, said article having different fatigue requirements in different portions thereof, and said metal powder containing ceramic inclusions which can serve as fatigue crack initiation sites, the improvement which comprises: screening at least a portion of said powder to produce a fine fraction and a coarse fraction and utilizing said fine fraction to fabricate that portion of the article having the most stringent fatigue requirement and said coarse fraction to fabricate that portion of the article having lesser fatigue requirements; then compacting, and densifying said powder article to produce a consolidated article in which that portion having the most stringent fatigue requirements contains smaller ceramic inclusions than that portion of the article having less stringent fatigue requirements.

* * * * *